US009603468B2

(12) United States Patent
Nilsson

(10) Patent No.: US 9,603,468 B2
(45) Date of Patent: Mar. 28, 2017

(54) HOLDING DEVICE FOR A BRACKET IN A STORAGE SYSTEM

(71) Applicant: ELFA INTERNATIONAL AB, V•stervik (SE)

(72) Inventor: Peter Nilsson, Västervik (SE)

(73) Assignee: ELFA INTERNATIONAL AB, Västervik (SE)

( * ) Notice: Subject to any disclaimer, the term of this patent is extended or adjusted under 35 U.S.C. 154(b) by 0 days.

(21) Appl. No.: 14/355,037

(22) PCT Filed: Oct. 25, 2012

(86) PCT No.: PCT/EP2012/071134

§ 371 (c)(1),
(2) Date: Apr. 29, 2014

(87) PCT Pub. No.: WO2013/064418

PCT Pub. Date: May 10, 2013

(65) Prior Publication Data

US 2014/0299562 A1 Oct. 9, 2014

(30) Foreign Application Priority Data

Oct. 31, 2011 (EP) ..... 11187250

(51) Int. Cl.
*A47B 96/06* (2006.01)
*A47F 5/00* (2006.01)
(Continued)

(52) U.S. Cl.
CPC ..... *A47F 5/101* (2013.01); *A47B 96/067* (2013.01); *A47F 3/06* (2013.01); *A47F 5/0018* (2013.01); *A47B 96/024* (2013.01)

(58) Field of Classification Search
CPC ..... A47B 96/024; A47B 96/067; A47B 96/16; A47B 96/06; A47B 96/061; A47B 96/066;
(Continued)

(56) References Cited

U.S. PATENT DOCUMENTS 661,557 A * 11/1900 Schwab ..... 52/27
3,536,287 A * 10/1970 Kramer ..... 248/301
(Continued)

FOREIGN PATENT DOCUMENTS

AU 557 878 B3 3/1987
CH 187 977 A 12/1936
(Continued)

OTHER PUBLICATIONS

International Search Report for PCT/EP2012/071134, mailed Dec. 4, 2012; ISA/EP.
(Continued)

*Primary Examiner* — Stanton L Krycinski
(74) *Attorney, Agent, or Firm* — Harness, Dickey & Pierce, P.L.C.

(57) ABSTRACT

The present disclosure relates to a holding device for a bracket in a storage system. The holding device has a connecting part and a holding part, the connecting part being elongated and bent, along a line in the elongated direction to form, in cross-section, a U-shape with a first and a second leg. The first leg is intended to be inserted into a bracket and second leg being connected to the holding part having a holding feature, such as hooks, a box, or a basket.

13 Claims, 2 Drawing Sheets

(51) Int. Cl.
*A47F 5/10* (2006.01)
*A47F 3/06* (2006.01)
*A47B 96/02* (2006.01)

(58) Field of Classification Search
CPC ..... A47B 57/42; A47B 57/425; A47F 5/0018; A47F 5/101; A47F 3/06; A47G 25/06; A47G 25/08
USPC ..... 211/126.16, 135, 88.01, 90.01; 248/73, 248/215, 225.21, 301
See application file for complete search history.

(56) References Cited

U.S. PATENT DOCUMENTS 3,599,918 A * 8/1971 Patchett ..... 248/85
D257,993 S * 1/1981 DeMars ..... D20/42
5,004,199 A * 4/1991 Suk ..... H02G 3/125 220/3.9
5,014,948 A * 5/1991 Asaro et al. ..... 248/215
5,037,051 A * 8/1991 Moriello ..... 248/215
5,246,190 A * 9/1993 Swirkal ..... 248/100
5,624,095 A * 4/1997 Zissu ..... 248/231.81
5,626,244 A * 5/1997 Mesna et al. ..... 211/60.1
D404,952 S * 2/1999 Bauer ..... D6/552
6,095,057 A * 8/2000 Corban ..... A47B 96/027 108/152
6,585,394 B2 * 7/2003 Diaco ..... 362/249.03
6,956,172 B2 * 10/2005 Dinh ..... 174/58
6,971,768 B1 * 12/2005 Pepito et al. ..... 362/238
6,993,847 B2 * 2/2006 Melton et al. ..... 30/216
7,073,757 B2 * 7/2006 Johnson et al. ..... 248/205.1
7,296,697 B2 * 11/2007 Costa ..... A47B 47/022 211/175
7,789,248 B1 * 9/2010 Salerno et al. ..... 211/85.7
7,819,365 B2 * 10/2010 Elsner ..... 248/74.3
8,398,316 B2 * 3/2013 Mota et al. ..... 396/427
8,517,320 B1 * 8/2013 Nicely ..... 248/223.41
8,820,619 B2 * 9/2014 James et al. ..... 229/120.31
2005/0189308 A1 * 9/2005 Warner et al. ..... 211/59.1
2008/0224002 A1 * 9/2008 Butow ..... 248/205.1
2011/0001026 A1 * 1/2011 Kubsad et al. ..... 248/223.41
2012/0228300 A1 * 9/2012 Wertman ..... 220/476

FOREIGN PATENT DOCUMENTS

CN 201453059 U 5/2010
DE 299 02 950 U1 7/2000
DE 20 2005 015705 U1 2/2007
GB 2 154 858 A 9/1985

OTHER PUBLICATIONS

Office Action from corresponding CN application citing above CN document, designated “A” category; OA dated Aug 28, 2015.

* cited by examiner

HOLDING DEVICE FOR A BRACKET IN A STORAGE SYSTEM

CROSS-REFERENCE TO RELATED APPLICATIONS

This application is a 371 U.S. National Stage of International Application No. PCT/EP2012/071134, filed Oct. 25, 2012, which claims priority to European Patent Application No. 11187250.3, filed on Oct. 31, 2011, the disclosures of which are herein incorporated by reference in their entirety.

TECHNICAL FIELD

The present disclosure relates to a storage device for a bracket in a storage system according to the preamble of claim 1.

BACKGROUND

Storage systems including releasable brackets that support shelves are widely used. Such systems are flexible and easy to install. One problem associated with such systems is to further increase their versatility.

SUMMARY

One object of the present disclosure is therefore to obtain a storage device of the initially mentioned kind that makes a storage system even more useful. This object is achieved by means of a storage device according to claim 1. More specifically this object is achieved by means of a holding device for a bracket in a storage system, where the device comprises a connecting part and a holding part. The connecting part is elongated, and bent, along a line in the elongated direction to form, in cross-section, a U-shape having a first and a second leg. The part corresponding to the first leg is intended to be inserted into a said bracket and the part corresponding to the second leg is connected to the holding part.

Such a holding device may be attached to a bracket that has a shelf on one side only, and where the other side is otherwise unused. The holding device may include e.g. hooks that are presented on said other side of the bracket, providing an improved storage solution.

The first leg of the connecting part may include at least one tongue, extending substantially perpendicular from the line where the connecting part is bent, and wherein the tongue is bent further towards the second leg compared to other parts of the first leg. This allows the holding device to be retained at the bracket such that it is not accidently removed. The distance between the first leg and the second leg may be e.g. 1.3-4.5 mm, and the minimum distance between a tongue and second leg may be e.g 0.9-1.15 mm. Further, the tip of the tongue may be bent outwards away from second leg to facilitate the fitting of the holding device onto the bracket.

The holding device may be made of sheet metal or e.g. plastic, and the holding part may include e.g. hooks, a box, or a basket.

The connecting part may further have a plurality of key-hole slots in the part corresponding to the first leg, that allow the holding device to be attached e.g. to a wall if desired.

Further, there is considered a combination of a holding device of the above mentioned kind and a bracket, wherein the bracket is intended to be connected to a carrier element in order to be able to support a shelf in a cantilevered fashion and has a U-shaped cross section, and wherein the first leg of the holding device has a size that allows the first leg to be inserted into the bracket, such that the bracket supports the holding device at the folding line where the connecting part is bent.

DETAILED DESCRIPTION

Figure 1:
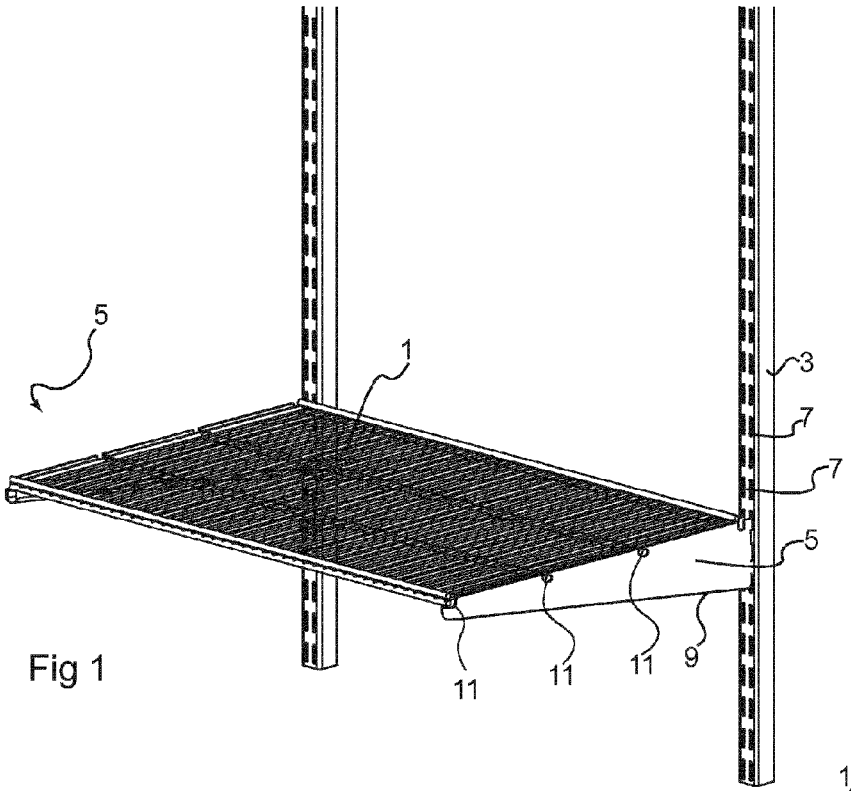
FIG. 1 illustrates a basic storage system according to known art.

The present disclosure relates to a holding/storage device for a storage system comprising detachably suspended shelves. FIG. 1 illustrates a basic storage system according to known art. The shelves 1 may be arranged to be suspended from a wall or in a free-standing arrangement. Usually, the system when assembled involves at least two elongated, essentially vertical carrier elements 3, at least two brackets 5 which are releasably attached to the respective carrier elements 3 at a desired height, and a shelf 1 that is suspended between the two brackets 5. The system, that is well known per se, may of course include any number of carrier elements, brackets, and shelves to be configured in any desired way by a user.

The carrier elements 3 may be free-standing on a floor and may then include feet or the like, but more commonly the carrier elements are attached, e.g. by screws, to a wall. The carrier elements may have a more or less rectangular, U-shaped cross-section, and when attached to a wall the open end of the U faces the wall. The other side of the U, i.e. the bottom of the U, interconnecting its two legs, has two parallel rows of slots 7, which rows extend along the length of the carrier element 3.

Each bracket 5 may be made in one piece of sheet metal that is bent into a U-shape. When mounted to a vertical carrier element the bend 9 of the bracket 5 will be facing downwards, and the two legs of the cross section U will be directed upwards. At one end, the bracket has hook-shaped projections that can be inserted into the slots 7 of the carrier elements 3, as is well known per se, in order to suspend the bracket on the carrier element in a cantilevered fashion.

The shelves 1 comprise fastening means that allows each end of a shelf to be attached to a bracket 5. The bracket may include recesses 11 that facilitate this operation, and help securing the shelf 1 on the bracket 5. Even though there exist shelves that cover the upper side of a bracket completely, a more common type of shelf only engages with only one side of a bracket with a U-shaped cross section, leaving the other half of the bracket U cross section free to a shelf that extends from the bracket in the other direction. Thus, each bracket may support two shelves.

The present disclosure however relates to a device that may prove useful in the case that a bracket supports only one shelf. Even if a great number of shelves are combined to form a long row, that row will have two ends, and at those ends, one half of the bracket, as seen in cross section, will be unused. The present disclosure therefore shows a holding storage device that can be used in this context, thus improving the overall storage system.

Figure 2:
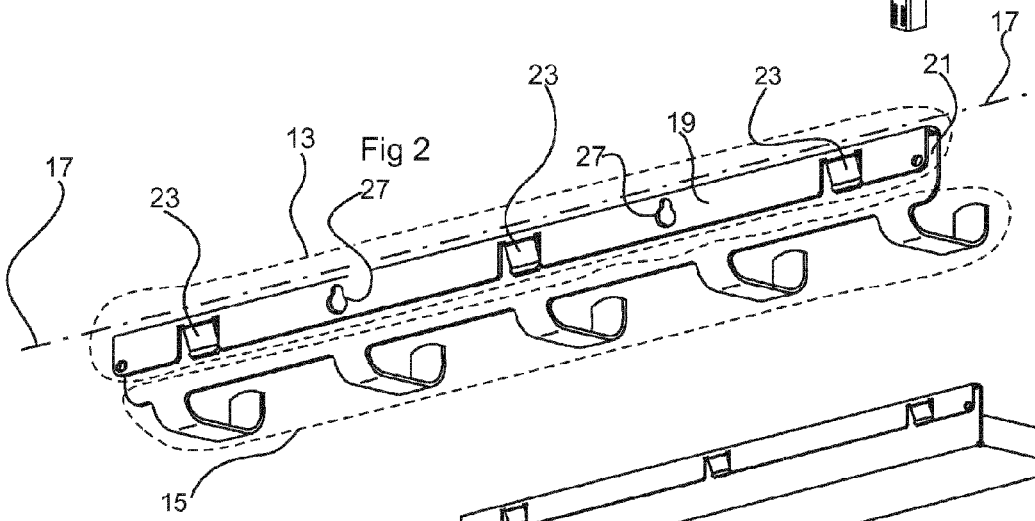
FIG. 2 shows an example of a storage device according to the present disclosure.
Figure 3:
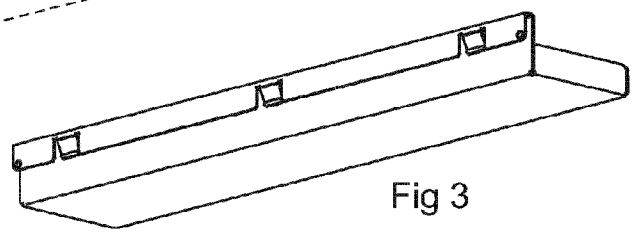
FIG. 3 shows another example of a storage device.

This storage or holding device is designed to be attached to a bracket in a storage system and may be embodied in different ways as illustrated with examples in FIGS. 2 and 3. The device has a connecting part 13 and a holding part 15.

Figure 5:
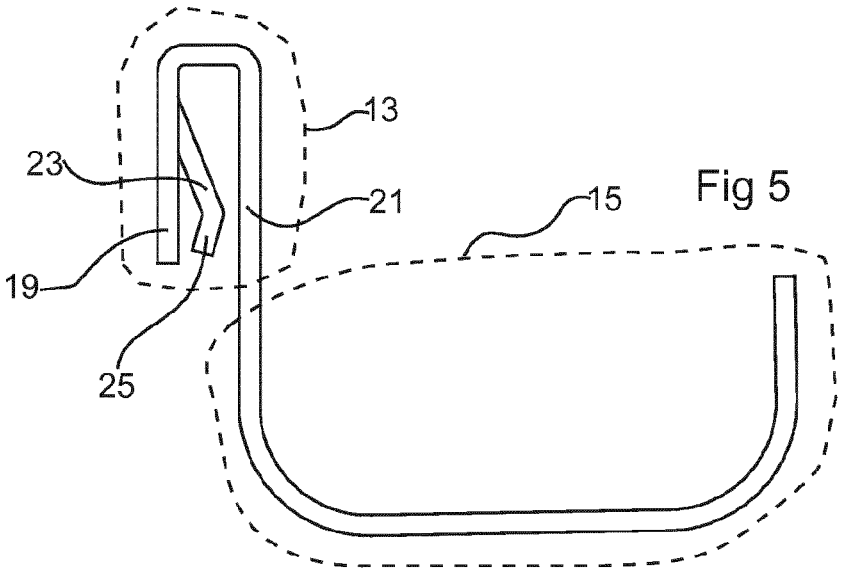
FIG. 5 illustrates a detailed side view of a storage device according to the present disclosure.

The connecting part 13 is elongated or stretched out to engage with the free half of the bracket along a major part of the bracket's length, and is bent, along a folding line 17 in the elongated direction. Thereby, a form is obtained that in cross-section resembles an upside-down U-shape, with a first 19 and a second 21 leg, as illustrated in FIG. 5. The part corresponding to the first leg 19 is intended to be inserted into a bracket and the part corresponding to the second leg is connected to a holding part 15 of some kind. The gap between the first and second legs may preferably be greater than the thickness (typically 1.25 mm) of the sheet metal that the bracket is formed of, such that the device can be easily fitted, typically the gap is in the range between 1.3 to 4.5 mm.

In a combination of a bracket and a holding device, the part corresponding to the first leg of the holding device has a size that allows the first leg to be inserted into the bracket, such that the bracket supports the holding device at the folding line 17 (cf. FIG. 2). As indicated in FIG. 4, the first leg may substantially occupy, at one side of the bracket, the available room in the bracket along the length of the bracket from the carrier element 3 and to the end of the cantilevered bracket.

Typically, the connecting part, and in many cases the holding device as a whole, may be made from sheet metal, and may even be made in one piece as illustrated in FIG. 2. However, it would also be possible to produce the connecting part or the holding device as a whole from a plastic material by injection moulding.

The holding part 15 is attached to or formed in one piece with the connecting part 13 and may include a number of hooks as illustrated in FIG. 2 or knobs, a box as illustrated in FIG. 3, a basket (not shown) or another feature that allows holding or retaining an object.

Figure 4:
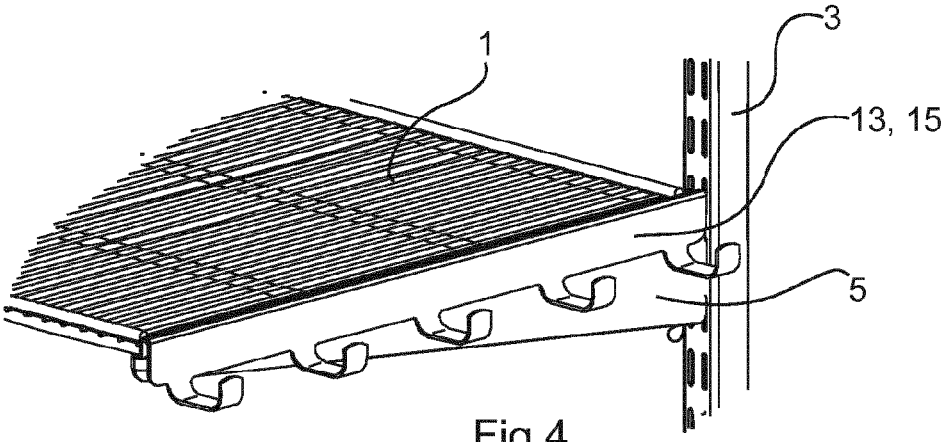
FIG. 4 shows a storage system where a storage device is fitted.

FIG. 4 shows a storage system where a storage device is fitted. As is apparent from the figure, the holding device provides five additional hooks, and at the same time conceals the otherwise unused half of the bracket, thereby providing a nice appearance.

FIG. 5 illustrates a detailed side view of the storage device in FIG. 2 and according to the present disclosure. The first leg 19 of the connecting part may preferably be provided with tongues 23 that serve to keep the holding device in place when fitted on a bracket. Such a tongue may be provided by cutting two spaced apart recesses (cf. FIG. 2 where three tongues are provided) in the first leg of the connecting part. The recesses extend from the edge of the part corresponding to the first leg and towards the folding line 17 (cf. FIG. 2). Thereby the tongues extend in the opposite direction, from the folding line and towards the free edge of the part corresponding to the first leg. Typically, a tongue may be 15-20 mm wide. The tongues may then be bent towards the second leg of the connecting part as is shown in FIG. 5. The minimum distance between the tongue 23 and the second leg 21 may then be smaller than the sheet metal thickness of the bracket on which the holding device is to be fitted. The tongue 23 will thus be resiliently urged towards this part of the bracket and may prevent that the holding device is accidently removed from the bracket. At the same time, as only a fraction of the first leg is resiliently urged in this way, the holding device may still be easily fitted onto the bracket, while being able to suspend a considerable weight in the vertical direction.

Typically, the distance between the first leg 19 and second leg 21 of the connecting part is in the range 1.3-4.5 mm, and the minimum distance between a tongue 23 and second leg 21 is in the range 0.9-1.15 mm. This is suitable for a bracket made of sheet metal with 1.25 mm thickness. Of course, those parameters can be varied, however it is suitable that the first mentioned distance is greater than, and the second distance smaller than, the bracket sheet metal thickness.

The tip 25 of a tongue 23 may be bent away from the second leg 21 of the connecting device in order to facilitate the fitting of the holding device. The distance between the tip and the second leg may then be greater than the bracket sheet metal thickness.

Further, the first leg 19 of the connecting part 13 may be provided with key-hole slots 27, as illustrated in FIG. 2. By a key-hole slot is here meant a hole that has wider lower part, allowing the head of a screw to be inserted, and a narrower upper part, which is wide enough to accommodate the shank of the screw but does not let the head pass. Provided with such openings, the holding device can, if desired, also be attached to a wall. Thereby, the versatility of the device is further increased.

The present disclosure is not limited to the embodiments described above and may be varied and altered in different ways within the scope of the appended claims. For instance, it is possible to use one bracket and two storage/holding devices of the type described above, one at each side, in the case that no shelf is suspended. Further, it is possible to produce a storage/holding device of the above described type with e.g. half the length, such that two devices can be fitted at one side of a bracket, e.g. providing two hooks and a small basket.

The invention claimed is:

1. A support for a storage or display system comprising:

a holding device including:

a connecting part being elongated and bent along a folding line in an elongated direction to form a U-shaped cross-section having a first leg and a second leg; and a holding part having a holding feature; and a bracket including:

a U-shaped cross section which is open upwards, wherein the bracket at one end comprises connectors to be connected to slots in a vertical carrier element in order to be able to support a shelf in a cantilevered fashion, wherein the first leg of the connecting part is configured to be inserted into the U-shaped cross section of the bracket and the second leg is connected to the holding part having the holding feature, wherein the first leg of the holding device has a size that allows the first leg to be inserted into the bracket, such that the bracket supports the holding device at said folding line; and wherein said first leg of the connecting part includes at least one tongue extending substantially perpendicular from the line where the connecting part is bent, and wherein the at least one tongue is bent further towards the second leg compared to a remainder of the first leg.

2. The support according to claim 1, wherein the bracket is formed from sheet metal having a thickness of 1.25 mm.

3. The support according to claim 1, wherein a distance between the first leg and the second leg is in a range of 1.3-4.5 mm, and a minimum distance between one of the at least one tongue and the second leg is in a range 0.9-1.15 mm.

4. The support according to claim 1, wherein a tip of the at least one tongue is bent outwards and away from the second leg.

5. The support according to claim 1, wherein the holding device is made of sheet metal.

6. A holding device for a storage system, wherein the device comprises:

a cantilevered bracket;

a connecting part and a holding part, wherein the connecting part is elongated and bent along a folding line in an elongated direction to form a U-shaped cross-section having a first and a second leg, the first leg of the connecting part is configured to be inserted into said bracket and the second leg is connected to the holding part having a holding feature, the first leg of the connecting part includes at least one tongue extending substantially perpendicular from the line where the connecting part is bent, the at least one tongue is bent further towards the second leg compared to a remainder of the first leg, and a distance between the first leg and the second leg is in a range of 1.3-4.5 mm, and a minimum distance between one of the at least one tongue and second leg is in a range of 0.9-1.15 mm.

7. The holding device according to claim 6, wherein an end of the at least one tongue is bent outwards and away from the second leg.

8. The holding device according to claim 6, wherein the holding device is formed from sheet metal.

9. The holding device according to claim 6, wherein the holding device is formed from plastic.

10. The holding device according to claim 6, wherein the holding part includes a plurality of hooks.

11. The holding device according to claim 6, wherein the holding part includes at least one box.

12. The holding device according to claim 6, wherein the holding part includes at least one basket.

13. The holding device according to claim 6, wherein the connecting part has a plurality of key-hole slots in the first leg.

* * * * *